US005440824A

United States Patent [19]

Ramachandran et al.

[11] Patent Number: 5,440,824

[45] Date of Patent: Aug. 15, 1995

[54] METHOD OF CLEANING GAS CYLINDERS WITH SUPERCRITICAL FLUIDS

[75] Inventors: Sivaramasubramanian Ramachandran, Warrington; Alfred U. Boehm, Chalfont, both of Pa.

[73] Assignee: MG Industries, Malvern, Pa.

[21] Appl. No.: 124,394

[22] Filed: Sep. 21, 1993

[51] Int. Cl.[6] ..... F26B 3/00

[52] U.S. Cl. ..... 34/443; 34/516; 15/406

[58] Field of Search ..... 34/443, 449, 516, 521; 134/1, 2, 10, 40; 15/305, 363, 406; 210/774; 204/157.21, 157.42, 157.5

[56] References Cited

U.S. PATENT DOCUMENTS 5,013,366 5/1991 Jackson et al. .

*Primary Examiner*—Denise L. Gromada
*Attorney, Agent, or Firm*—William H. Eilberg

[57] ABSTRACT

The interior of a gas cylinder is cleaned using a supercritical fluid. A treating material, such as carbon dioxide, is injected into the cylinder, and the pressure in the cylinder is increased until the pressure of the treating material exceeds its critical pressure. Then, the cylinder is heated until the temperature of the treating material exceeds its critical temperature. The treating material therefore becomes a supercritical fluid. The treating material is maintained in its supercritical state while the cylinder is rolled for a period of time, while the supercritical fluid dissolves contaminants on the interior surface of the cylinder, and on objects within the cylinder. Then, the supercritical fluid is vented from the cylinder, preferably while the fluid in the cylinder is maintained in its supercritical state. This process provides exceptionally thorough cleaning of the interior of the cylinder, and makes it possible to provide a cylinder gas having a level of contaminants of the order of parts per billion or better.

5 Claims, 2 Drawing Sheets

METHOD OF CLEANING GAS CYLINDERS WITH SUPERCRITICAL FLUIDS

BACKGROUND OF THE INVENTION

This invention relates to the field of cleaning gas cylinders, and provides a method and apparatus for cleaning such cylinders using supercritical fluids.

When emptied, a cylinder still retains a small amount of the gas or liquefied gas that was previously stored therein. Even a brand new cylinder will have contaminants such as vacuum pump oil, as well as residue from the manufacturing process. Thus, various contaminants may accumulate on the interior surfaces of the cylinder. If one desires to provide a cylinder gas having exceptionally high purity, with contaminant levels of the order of parts per billion, or parts per trillion, it is necessary to clean the cylinder very thoroughly before filling.

Various conventional methods of cleaning a gas cylinder have been known, and many such methods are specifically intended to remove certain contaminants. One such method is baking and evacuating. In this technique, one places a cylinder in an oven, and heats it so as to drive off contaminants. The interior of the cylinder is purged and evacuated. Then, the process is repeated, several times if necessary, until the level of contaminants is within the desired range.

Other methods of gas cylinder cleaning involve various kinds of chemical treatment. For example, one can treat the cylinder with a solution of hydrogen fluoride. One can also clean a cylinder with high-pressure steam.

All of the above-described methods are limited in how thoroughly they can clean a gas cylinder. When it is desired to reduce contaminant levels below the part per billion (ppb) range, the conventional methods will not suffice. The need to reduce contaminant levels to these values has become especially apparent in recent years, in view of the enactment of increasingly strict environmental regulations.

It has been known that a supercritical fluid acts as an effective solvent, and can remove contaminants. U.S. Pat. No. 5,013,366 describes a cleaning process which uses a supercritical fluid to clean various objects within a cleaning chamber. In the latter patent, the temperature of a supercritical fluid is varied in a series of discrete steps, so that, during each step, the fluid can dissolve a predetermined set of contaminants.

The present invention provides a method and apparatus which exploits the benefits of supercritical fluids in a new manner, to provide exceptionally thorough cleaning of the interior of gas cylinders. In particular, the present invention essentially rids the cylinder of contaminants such as hydrocarbons and fluorocarbons, and other contaminants. The present invention therefore makes it possible to provide cylinder gases having a contaminant level of the order of parts per billion or better.

SUMMARY OF THE INVENTION

The method of the present invention cleans a gas cylinder according to the following steps. First, a treating material (for example, carbon dioxide) is directed into the cylinder. The treating material may already have a pressure above its critical pressure before being injected into the cylinder. Otherwise, the treating material is pressurized after entering the cylinder, so that its pressure rises above the critical pressure. The cylinder is then heated by an amount sufficient to raise the temperature of the treating material above its critical temperature. The treating material inside the cylinder therefore becomes a supercritical fluid. The supercritical fluid acts as an effective solvent, removing contaminants from the interior surface of the cylinder, and from objects within the cylinder.

Preferably, the cylinder is rolled while it is heated, to insure optimum mixing and dispersion of the supercritical fluid. The fluid is maintained in its supercritical state, by the continued application of heat, for a time sufficient to clean the cylinder.

After the cylinder has been cleaned, the process is concluded by releasing the supercritical fluid from the cylinder. This releasing step is preferably performed while the pressure inside the cylinder is maintained above the critical pressure. One maintains the pressure inside the cylinder by injecting another gas, such as an inert gas, or relatively inert gas, into the cylinder, while the contents of the cylinder are being released.

The present invention therefore has the primary object of providing a method and apparatus for cleaning the interior surface of a gas cylinder.

The present invention has the further object of reducing the amount of contaminants in a gas cylinder to a level of the order of parts per billion or better.

The present invention has the further object of facilitating the production, storage, and handling of extremely pure industrial or specialty gases.

The present invention has the further object of using supercritical fluids as solvents in the cleaning of the interiors of gas cylinders.

The reader skilled in the art will recognize other objects and advantages of the present invention, from a reading of the following brief description of the drawings, the detailed description of the invention, and the appended claims.

DETAILED DESCRIPTION OF THE INVENTION

The present invention is a method and apparatus for cleaning a gas cylinder. The method can be used for treating cylinders with the cylinder valves and dip tubes installed. The same process can be used with cylinders not having valves and/or dip tubes.

In this specification, the term "gas cylinder" is intended to include cylinders whose contents are liquefied gases or other liquids. The invention is therefore not limited to the case in which only gas is present in the cylinder.

The essential steps of the process are as follows. First, one fills the cylinder with a treating material. A preferred treating material is carbon dioxide, although other materials can be used. The amount of carbon dioxide depends on the size of the cylinder used. For example, a cylinder with an internal volume of about one cubic foot may require about two pounds of $CO_2$. The actual amount of treating material required will depend on the cylinder size, the type of treating material used, and the type of service the cylinder has experienced. The latter example is for illustrative purposes, and is not intended to limit the invention.

After the cylinder is filled with the treating material, the pressure in the cylinder is increased to a value above the critical pressure of the material. In the case of $CO_2$, a pressure of 1200 psig in the cylinder may be required, since the critical pressure for $CO_2$ is 1070.67 psia. The increase in pressure is accomplished by introducing an inert gas, such as helium, into the cylinder which already contains the $CO_2$. This "topping gas" should be of very high purity. If another treating material is used, it may or may not be necessary to use a topping gas.

Next, the pressurized cylinder is heated to a temperature above the critical temperature of the treating material. For example, in the case of $CO_2$, a temperature of 40° C. may be required. The critical temperature of $CO_2$ is 31.1° C. In the preferred embodiment, one rolls the cylinder on a roller while it is being heated. When the critical temperature is exceeded, the treating material becomes a supercritical fluid. The rolling action assures that the supercritical fluid contacts all regions within the cylinder. The heating and rolling of the cylinder may continue for an extended period of time, of the order of up to 30 minutes.

In the example given above, wherein carbon dioxide is the treating material, the treating material is initially a gas. But after being pressurized and heated, it can no longer be considered a gas, but instead becomes a supercritical fluid.

After a period of time, of the order of 15 minutes, the cylinder is emptied, preferably while maintaining the supercritical condition within the cylinder, to the extent possible. If further cleaning is necessary, the above steps can be repeated one or more times.

Figure 1:
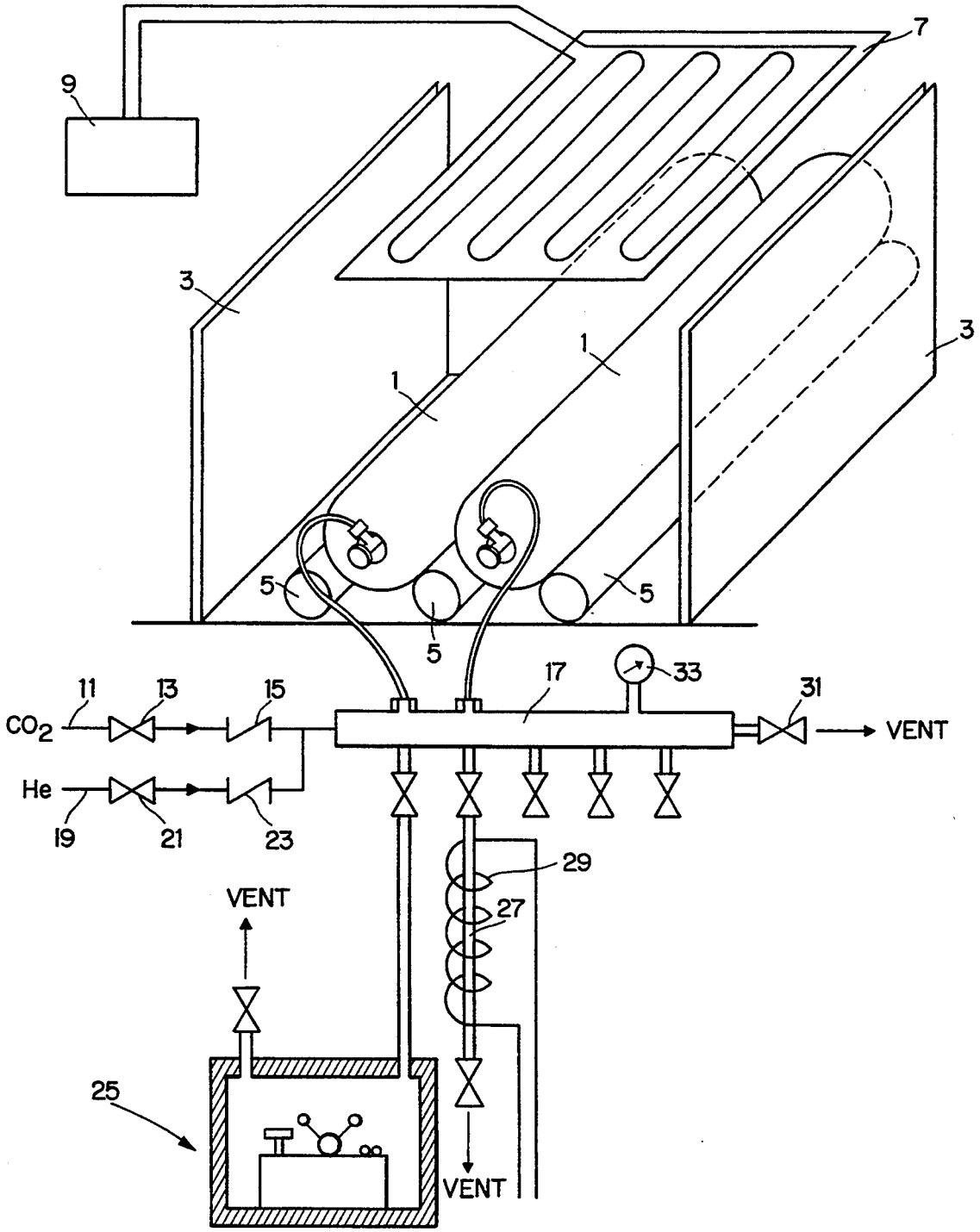
FIG. 1 provides a schematic diagram of a cylinder cleaning apparatus constructed according to the present invention.

FIG. 1 shows a schematic diagram of an apparatus which can be used for practicing the present invention. Gas cylinders 1 are held between insulated walls 3. As shown in FIG. 1, the walls do not form a complete chamber. Instead, they are used to reduce heat loss from the cylinders. This heat loss is normally greatest along the cylinder walls, and thus the insulated walls are placed parallel to the cylinder walls. Note, however, that the invention can be practiced with only one insulated wall, or without any such walls.

The cylinders rest on rollers 5. The rollers are rotated by a conventional motor (not shown). A heating panel 7 provides heat to the cylinders, and the temperature of the cylinders is controlled by temperature controller 9.

The treating material, which in the example of FIG. 1 is $CO_2$, is conveyed through conduit 11, through control valve 13 and check valve 15, into manifold 17. The topping gas, which in the example of FIG. 1 is helium, is conveyed through conduit 19, through control valve 21, through check valve 23, and into the manifold. In FIG. 1, two ports of the manifold are connected to a pair of cylinders 1. The manifold includes other ports which can be connected to additional cylinders, or to other components. One such component, in the example of FIG. 1, is a high pressure oven 25, within which various objects, such as cylinder valves and regulators, can be treated with the supercritical fluid. FIG. 1 also illustrates the use of the invention to clean a process line 27. The process line is surrounded by resistive heating coil 29 to allow the fluid in line 27 to be maintained above the critical temperature. The manifold can be vented through valve 31. The pressure in the manifold can be monitored with gauge 33. Similar valves capable of functioning as vents are shown on oven 25 and process line 27. Manifold 17 also has a plurality of ports which are shown without connections to external components.

Figure 2:
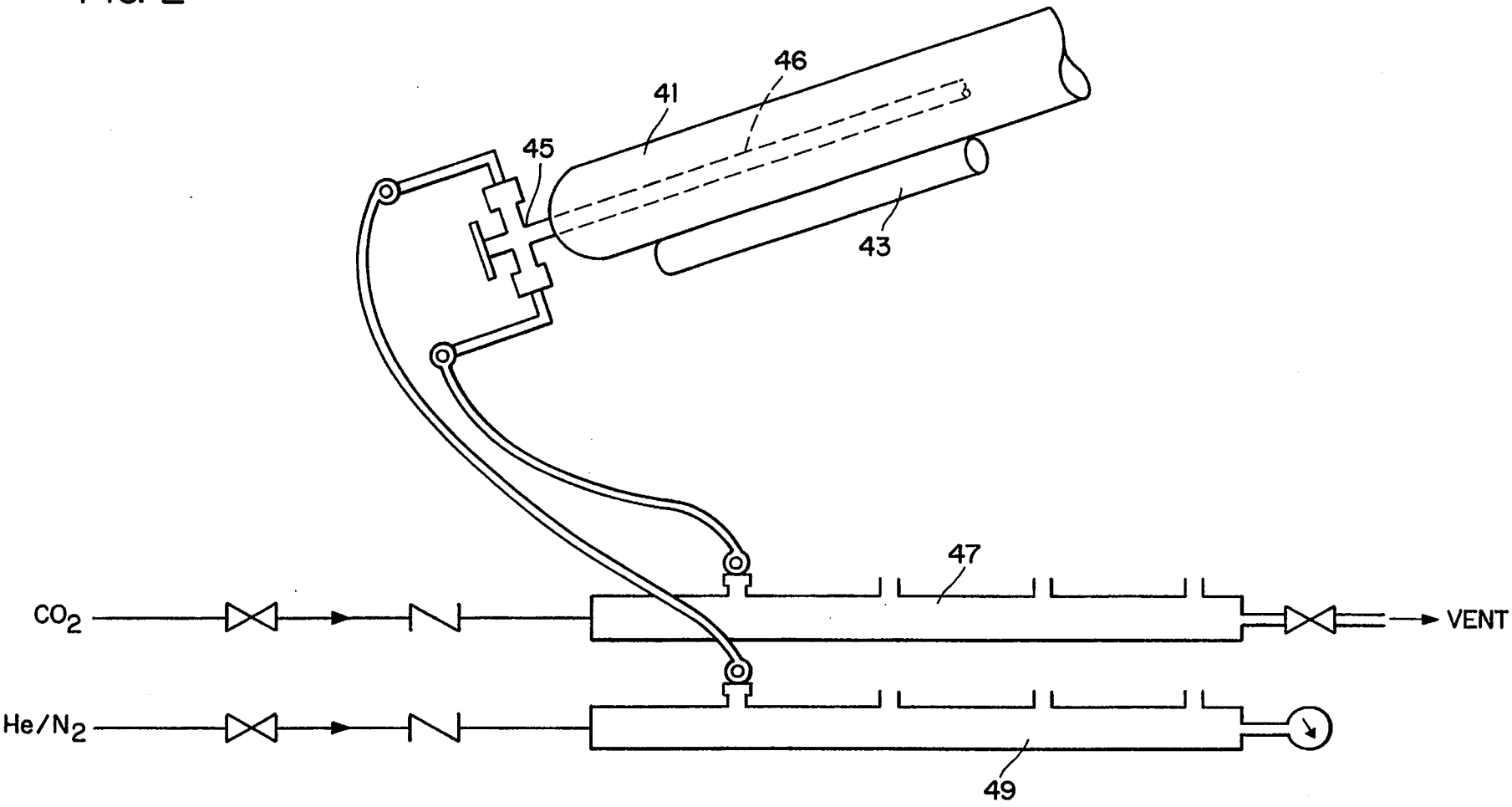
FIG. 2 provides a schematic diagram showing a cylinder connected to a dual valve, for supplying a cleaning gas and a topping gas, in practicing the method of the present invention.

FIG. 2 shows an alternative arrangement. For purposes of clarity, FIG. 2 shows only a single cylinder 41. However, it is understood that in the embodiment of FIG. 2, one could provide one or more heat-insulating walls, and one could also provide multiple cylinders. FIG. 2 symbolically illustrates one of the rollers 43 on which the cylinder rests.

In FIG. 2, there are two manifolds 47 and 49. Manifold 47 receives the treating material (such as $CO_2$), and manifold 49 receives the topping gas (such as helium or nitrogen). Each manifold is shown with only one of its ports connected to the cylinder; the other ports are shown without any connections. It is understood that, in practice, these other ports would be connected to additional cylinders, or else they would be closed off.

The cylinder has a dual valve 45 connected to dip tube 46. The two ports of the dual valve are connected to respective ports of the two manifolds. The ports of the dual valve are known as the "vapor" port and the "liquid" port. The connections to the dual valve on the cylinder and to the manifolds are made with swivel fittings which allow the cylinder to roll continuously while being filled or purged. Such swivel fittings are well-known and commercially available. One can use any such fitting that provides a fluid tight seal while permitting 360° rotation.

The dual valve makes it easier to increase the cylinder pressure by using an inert gas, and also makes it easier to purge the cylinder continuously near the end of the cleaning cycle.

A typical sequence of process steps, using the arrangement of FIG. 2, is as follows. Note, however, that except for the steps which specifically require the use of the dual valve or the two separate manifolds, these same steps could be applied in the embodiment of FIG. 1.

First, if necessary, one may pretreat the cylinder. Such pretreatment can be by any conventional means, such as baking and evacuation, described above. During the pretreatment step, the cylinder valve and/or the dip tube may or may not be installed.

After pretreatment, if the dip tube and the dual cylinder valve are not installed, one should now install them, following the standard procedures used in the industry. Note that after pretreatment, there will still be some contaminants in the cylinder.

Next, one places the cylinder or cylinders on the roller(s). At this point, the cylinder may be completely evacuated or it may contain an inert gas such as helium or nitrogen, at low pressure (of the order of 20–100 psig).

Next, one connects the vapor port of the dual valve to the manifold which supplies the topping gas. Note that the same gas can be used as a topping gas and as a purging gas. One connects the liquid port of the dual valve to the manifold which supplies the treating material (e.g. $CO_2$ in the example of FIG. 2).

Then, one opens the appropriate valves to introduce a predetermined quantity of the treating material, such as $CO_2$, into the cylinder. The quantity of treating material introduced can be monitored or regulated using appropriate mass flow measurement devices.

Next, one closes all the valves. Depending upon the fluid, the pressure inside the cylinder may or may not be above the critical pressure. If the pressure in the cylinder is less than the critical pressure, one introduces a topping gas, such as helium or nitrogen, through the vapor port of the dual valve, to raise the pressure in the cylinder above the critical pressure. Preferably, one uses an inert gas, such as helium, or a relatively inert gas, such as nitrogen. In one example, nitrogen or helium may be introduced into the cylinder to raise the pressure above the 1200 psig level required to assure that $CO_2$ will be above its critical pressure. It is also possible to pump the treating material into the cylinder at pressures greater than the critical pressure. In the latter case, a topping gas may not be needed. However, a purging gas is still needed.

After the pressure in the cylinder has been increased above the critical pressure, the valves are closed, and the cylinder is heated until the treating material has a temperature greater than its critical temperature. For example, in the case of $CO_2$, the cylinder may be heated to about 35°–40° C. A temperature controller may be used to regulate the temperature. When the temperature reaches this level, and the pressure in the cylinder is maintained, the treating material becomes a supercritical fluid.

Preferably, the cylinders are rolled while being heated, to insure uniform distribution of the treating material. The heating and rolling is continued for a predetermined time, of the order of about 15 minutes.

Next, the contents of the cylinder are released, while the pressure inside the cylinder is maintained above the critical pressure. The pressure is maintained by opening the valves which supply the purging gas or topping gas, while allowing the contents of the cylinder to escape through the other manifold. For example, in FIG. 2, one opens the valves which allow helium or nitrogen to flow into manifold 49 and into the cylinder, while at the same time opening the portion of dual valve 45 which allows fluid to flow from the cylinder to manifold 47 and out of the manifold. Thus, although the fluid in the cylinder is being released, the continuous injection of the topping/purging gas maintains the pressure in the cylinder. The latter step is important because, by maintaining the contents of the cylinder at supercritical conditions, the contaminants remain dissolved in the supercritical fluid, and are more easily flushed out as the fluid is vented from the cylinder. If the fluid in the cylinder were allowed to become subcritical, at least some of the contaminants would likely remain in the cylinder. If necessary, the manifold can be heated or insulated.

The latter purging step can be continued for a predetermined amount of time, such as for about 15 minutes.

Finally, the valves controlling the flow of purging gas, and the cylinder valves, are all closed. The rollers are stopped, the heater element is deactivated, and the cylinder connections are disconnected.

Note that the topping gas and the purging gas can be the same gas. The difference between "topping" and "purging" is determined by whether the contents of the cylinder are allowed to escape. If the contents of the cylinder are not vented, addition of an inert gas constitutes "topping". If the contents of the cylinder are vented, addition of an inert gas constitutes "purging".

The process described above can be modified in various ways. For example, a chemical modifier may be added to the supercritical fluid, or to the treating material which becomes the supercritical fluid, to enhance the ability of the fluid to remove some contaminants. The modifier can be added prior to loading the cylinder onto the roller. One can introduce the modifier by standard techniques such as by using a syringe and a septum. Possible modifiers include methanol, acetone, n-octane, and n-pentane.

The above discussion refers to carbon dioxide as the treating material which becomes the supercritical fluid. However, the same principles apply to many other materials, such as xenon, ammonia, propane, sulfur hexafluoride, nitrous oxide, and fluoroform, all of which can be pressurized and heated to reach their supercritical states. It is also possible to use a mixture of different treating materials to dissolve a particular set of contaminants. Of course, the temperatures and pressures required to operate the process will vary according to the treating materials used. What is important is that the treating material be raised above its critical pressure and temperature so that it becomes a supercritical fluid.

In the above examples, the topping gas or purging gas was helium or nitrogen. However, other gases could be used, such as argon, or other noble gases.

The arrangement shown in the figures can be varied substantially. Additional valves can be added to achieve a greater degree of control. The entire process can be automated and controlled by a computer or microprocessor.

As suggested by FIG. 1, the process can also be used to clean the interior surfaces of a process line. As indicated in FIG. 1, one would heat the process line by surrounding it with a suitable heating element, so as to raise the temperature of the fluid within the line above its critical temperature.

Other modifications of the invention will be apparent to persons skilled in the art. Such modifications are intended to be included within the spirit and scope of the following claims.

What is claimed is:

1. Apparatus for cleaning a gas cylinder with a supercritical fluid, the cylinder having an interior region, the apparatus comprising:

a) at least one roller, the roller comprising means for rolling the gas cylinder, b) means for heating the cylinder, and c) conduit means for directing a treating material and a topping gas into a manifold, and means for connecting the manifold to the cylinder, wherein the treating material and the topping gas can be directed into the interior region of the cylinder.

2. The apparatus of claim 1, further comprising at least one thermally insulated wall disposed near the cylinder.

3. The apparatus of claim 2, wherein the cylinder has side wall, and wherein there are two thermally insulated walls, the thermally insulated walls being arranged generally parallel to the side wall of the cylinder.

4. The apparatus of claim 1, wherein the cylinder has a dual valve, the dual valve having first and second ports, and wherein the apparatus includes means for directing the treating material into the first port and means for directing the topping gas into the second port.

5. The apparatus of claim 4, wherein there are two manifolds, and wherein the means for directing the treating material includes a first manifold, and wherein the means for directing the topping gas includes the second manifold.

* * * * *